US010695776B2

(12) United States Patent
Maguire et al.

(10) Patent No.: US 10,695,776 B2
(45) Date of Patent: Jun. 30, 2020

(54) DISPENSING VALVE FOR PRESSURE PACK

(71) Applicant: Rocep Lusol Holdings Limited, Glasgow (GB)

(72) Inventors: Jordan Maguire, Glasgow (GB); Bernard Frutin, Glasgow (GB)

(73) Assignee: Rocep Lusol Holdings Limited, Glasgow (GB)

( * ) Notice: Subject to any disclaimer, the term of this patent is extended or adjusted under 35 U.S.C. 154(b) by 0 days.

(21) Appl. No.: 16/324,215

(22) PCT Filed: Aug. 16, 2017

(86) PCT No.: PCT/GB2017/052405

§ 371 (c)(1),
(2) Date: Feb. 8, 2019

(87) PCT Pub. No.: WO2018/033723

PCT Pub. Date: Feb. 22, 2018

(65) Prior Publication Data

US 2019/0168242 A1 Jun. 6, 2019

(30) Foreign Application Priority Data

Aug. 16, 2016 (GB) ..... 1614010.5

(51) Int. Cl.
*B65D 83/14* (2006.01)
*B05B 1/30* (2006.01)
(Continued)

(52) U.S. Cl.
CPC ..... *B05B 1/3013* (2013.01); *B65D 83/48* (2013.01); *B05B 1/14* (2013.01)

(58) Field of Classification Search
CPC ..... B65D 83/14; B65D 83/20; B65D 83/48; B65D 83/00; B65D 83/30; B65D 83/40;
(Continued)

(56) References Cited

U.S. PATENT DOCUMENTS 2,686,652 A * 8/1954 Carlson ..... B65D 83/20 222/402.24
2,839,225 A * 6/1958 Soffer ..... B65D 83/425 222/402.16

(Continued)

FOREIGN PATENT DOCUMENTS

BE 726647 A 6/1969
EP 0486198 B1 2/2001

(Continued)

OTHER PUBLICATIONS

Eberwein, Michael, "International Search Report," prepared for PCT/GB2017/052405, dated Nov. 3, 2017, three pages.

*Primary Examiner* — Charles Cheyney
(74) *Attorney, Agent, or Firm* — Winstead PC

(57) ABSTRACT

A valve assembly (10) for dispensing a flowable product from a pressurised container (200), the valve assembly comprises a resilient sleeve member (16) comprising a lower fixing portion (18), an intermediate deformable portion (20) and an upper sealing portion (22), a valve stem (28) extending within the resilient sleeve member (16) and fixed to the lower fixing portion (18) of the resilient sleeve member (16), and an actuator (46) mounted on the upper sealing portion (22) of the resilient sleeve member (16). The valve stem (28) includes a hollow cylindrical body (38), an end cap (32) closing an upper end of the hollow cylindrical body (38), and one or more apertures (34) arranged around the circumference of the hollow cylindrical body (38) adjacent to the end cap (32). The apertures (34) are covered by the upper sealing portion (22) of the resilient sleeve member (16) in a closed position of the valve assembly (10). The actuator (46) includes a first actuator bearing surface (54) adapted to engage with a corresponding bearing surface (56) on the upper sealing portion (22) of the resilient sleeve member (16), such that movement of the actuator (46) downwards
(Continued)

opens the apertures (34) and resilient movement upwards recloses the apertures (34) to form a seal. This means that after use any product remaining within the valve stem (28) is below the location of the seal and is not in communication with the atmosphere, so it will not deteriorate.

14 Claims, 5 Drawing Sheets

(51) Int. Cl.
*B65D 83/48* (2006.01)
*B05B 1/14* (2006.01)

(58) Field of Classification Search
CPC B05B 1/3013; B05B 1/14; B05B 1/16; B05B 1/12
USPC ..... 222/402.1, 402.24, 402.21
See application file for complete search history.

(56) References Cited

U.S. PATENT DOCUMENTS

| | | | | | |
|---|---|---|---|---|---|
| 2,965,270 | A * | 12/1960 | Soffer | B65D 83/46 | 222/402.22 |
| 3,450,314 | A * | 6/1969 | Gross | B65D 83/14 | 222/402.24 |
| 3,540,634 | A * | 11/1970 | Mayercik | B65D 83/20 | 222/402.21 |
| 3,613,728 | A * | 10/1971 | Steinnan | B65D 83/14 | 137/614.19 |
| 3,682,355 | A * | 8/1972 | Lo | B65D 83/20 | 222/94 |
| 4,442,959 | A | 4/1984 | Del Bon et al. | | |
| 4,752,020 | A * | 6/1988 | Grueter | B65D 83/205 | 222/153.14 |
| 6,321,951 | B1 * | 11/2001 | Frutin | B65D 83/201 | 222/389 |

FOREIGN PATENT DOCUMENTS

| | | |
|---|---|---|
| EP | 1021357 B1 | 3/2004 |
| WO | WO-0149585 A1 | 7/2001 |

* cited by examiner

DISPENSING VALVE FOR PRESSURE PACK

This invention relates to a valve used with pressure packs for dispensing a pressurised component from the pressure pack. Particularly, but not exclusively, it relates to a valve used to dispense a viscous material from a container under pressure of a propellant.

Known dispensing apparatus commonly includes a valve mechanism fitted to a container which is refilled with a product, for example mastic or sealant, which is to be dispensed. One example is the valve mechanism disclosed in WO 01/49585 (Rocep Lusol Holdings Limited). The valve assembly includes a mounting cup having a standard circular rolled flange adapted to fit over the opening in a container, a rubber grommet sealed and secured by a circumferential groove to an aperture in the mounting cup, a valve stem held in the grommet by a retaining sleeve of the grommet, and a sealing disc fixed to the lower end of the valve stem. The sealing disc seals against the lower sealing surface of the grommet under the resilient action of the grommet retaining sleeve. When the valve stem is urged downwards by an actuator and/or lever, the retaining sleeve deforms and the sealing disc is urged away from the lower sealing surface of the grommet, thereby providing a passage from the container through apertures provided in the valve stem adjacent to the sealing disc and into the interior of the valve stem. A nozzle is provided at the upper end of the valve stem, so that depression of the valve stem by an actuator and/or lever allows pressurised product to flow from the container through the valve stem and through the nozzle.

The known arrangement suffers from the disadvantage that after operation of the valve to dispense pressurised product, product remains in the valve stem. If the dispensing apparatus remains unused for a period of time, the product in the valve stem may harden through its exposure to the atmosphere, even though the product remaining in the container is not exposed to the atmosphere and may have a long shelf life. The hardening of the product in the valve stem may render the dispensing apparatus unusable, leading to wastage of the unused product in the container.

It is an object of the present invention to provide a dispensing apparatus overcomes one or more of the above mentioned disadvantages.

According to a first aspect of the present invention there is provided a valve assembly for dispensing a flowable product from a pressurised container, the valve assembly comprising:

- a resilient sleeve member comprising a lower fixing portion, an intermediate deformable portion and an upper sealing portion,
- a valve stem extending within the resilient sleeve member and fixed to the lower fixing portion of the resilient sleeve member,
- an actuator mounted on the upper sealing portion of the resilient sleeve member,
- wherein the valve stem includes a hollow cylindrical body, an end cap closing an upper end of the hollow cylindrical body, and one or more apertures arranged around the circumference of the hollow cylindrical body adjacent to the end cap, the apertures being covered by the upper sealing portion of the resilient sleeve member in a closed position of the valve assembly, and
- wherein the actuator includes an interior flow passage and a first actuator bearing surface adapted to engage with a corresponding bearing surface on the upper sealing portion of the resilient sleeve member, such that movement of the actuator downwards from the closed position of the valve assembly to an open position of the valve assembly causes the intermediate deformable portion of the resilient sleeve member to deform such that the apertures are not covered by the upper sealing portion of the resilient sleeve member.

The valve assembly is sealed in the closed position by the upper sealing portion of the resilient sleeve member, which seals against the valve stem at its upper end, against the end cap or the exterior surface of the valve stem adjacent to the end cap. This means that after use any product remaining within the valve stem is below the location of the seal and is not in communication with the atmosphere, so it will not deteriorate. The actuator itself may be removed from the resilient sleeve member, if required, in order to clean the actuator and/or to remove any product remaining within the actuator.

The valve assembly may further comprise a mounting cup, the resilient sleeve member being mounted within an aperture in the mounting cup.

Preferably the mounting cup is a 1 inch (25.4 mm) mounting cup adapted for use with aerosol type containers.

The actuator may be removably mounted on the upper sealing portion of the resilient sleeve member. For example the actuator may include a recess adapted to fit around the upper sealing portion of the resilient sleeve member, such that the actuator may be removed from the resilient sleeve member by simple pulling action for cleaning purposes.

The actuator may include an interior flow passage.

In the open position of the valve assembly the hollow cylindrical body of the valve stem may be in fluid communication through the one or more apertures with the interior flow passage of the actuator.

The valve assembly may thus be opened by urging the actuator downwards, thereby creating a flow path for the pressurised flowable product through the valve stem, through the apertures and into the interior flow passage of the actuator.

The actuator may include a second actuator bearing surface adapted to engage with a corresponding bearing surface of a lever assembly.

This enables the actuator to be urged downwards by operation of a lever, for example the lever assembly disclosed in WO 01/49585.

The actuator may be mounted on the upper sealing portion of the resilient sleeve member for tilting movement, such that tilting the actuator from the closed position of the valve assembly to a tilted open position of the valve assembly causes the intermediate deformable portion of the resilient sleeve member to deform such that at least one of the apertures is not covered by the upper sealing portion of the resilient sleeve member.

As an alternative to an axial movement of the actuator, by means of a lever or other action, the valve assembly may be opened by tilting the actuator to one side, which wall cause the intermediate deformable portion to deform on one side only, thereby opening only one or some of the apertures.

The end cap may include an end cap sealing surface adapted to seal against a corresponding sealing surface of the upper sealing portion of the resilient sleeve member in the closed position of the valve assembly.

The resilient effect of the intermediate deformable portion of the resilient sleeve member may thus urge the upper sealing portion upwards against the end cap sealing surface to maintain the seal in the closed position of the valve assembly.

The hollow cylindrical body of the valve stem may comprise an upper tubular portion having a uniform circular cylindrical wall. The end cap sealing surface may be inclined at an acute angle to the longitudinal axis of the valve stem. The sealing surface may extend radially beyond the circular cylindrical wall of the valve stem.

The upper sealing portion is thus free to slide axially relative to the upper tubular portion of the valve stem. When the actuator is urged downwards the upper sealing portion slides down the upper tubular portion to open the valve assembly. When the actuator is released the resilience of the resilient sleeve member urges the upper sealing portion to slide back up the upper tubular portion until the sealing surfaces engage and close the valve assembly.

The actuator may include a nozzle at its upper end. Alternatively the actuator may include an engaging means, for example an external thread, on its external surface adapted to engage with a corresponding engagement means, for example an internal thread, on a nozzle member.

The valve assembly may further comprise a nozzle member mounted on the actuator. The nozzle member may include a nozzle at its upper end.

According to a second aspect of the present invention there is provided a dispensing apparatus comprising a container which may be pressurised and a valve assembly according to the first aspect secured to an aperture in the container.

The dispensing apparatus may further comprise a flowable product in the container.

The container may be a tubular container, for example of metal.

The dispensing apparatus may further comprise a pressurised propellant in the container and barrier means separating the pressurised propellant from the flowable product.

The barrier means may comprise one or more pistons. Suitable pistons are disclosed in EP1021357B, for example. Alternatively the barrier means may comprise a flexible membrane, for example a bag secured to the valve assembly.

According to a third aspect of the present invention there is provided a method of dispensing a pressurised flowable product from a dispensing apparatus comprising a container and a valve assembly, the valve assembly comprising:

- a resilient sleeve member comprising a lower fixing portion secured to an aperture in the container, an intermediate deformable portion and an upper sealing portion,
- a valve stem extending within the resilient sleeve member and fixed to the lower fixing portion of the resilient sleeve member, and
- an actuator provided on the upper sealing portion of the resilient sleeve member, the method comprising the steps of:

- moving the actuator downwards from a closed position of the valve assembly, in which the upper sealing portion seals against a sealing surface at an upper end of the valve stem, to an open position of the valve assembly, in which at least part of the upper sealing portion is spaced from the sealing surface at the upper end of the valve stem, and
- propelling flowable product from the container though the valve stem, through at least one aperture in the valve stem adjacent to the sealing surface at the upper end of the valve stem, into an interior flow passage in the actuator, and through a nozzle in communication with the interior flow passage.

The valve assembly may be a valve assembly according to the first aspect of the invention.

The dispensing apparatus may be a dispensing apparatus according to the second aspect of the invention.

The step of propelling flowable product may be accomplished by pressurised propellant in the container.

The step of moving the actuator downwards may include deforming the intermediate deformable portion of the resilient sleeve member against the resilience of the intermediate deformable portion.

The step of moving the actuator downwards may comprise using a lever to apply a downwards force to the actuator so that the entire upper sealing portion is spaced from the sealing surface at the upper end of the valve stem.

The step of moving the actuator downwards may comprise tilting the actuator to one side such that part of the upper sealing portion is spaced from the sealing surface at the upper end of the valve stem.

The method may comprise the further step of:

- moving the actuator upwards from the open position to the closed position to prevent the further propulsion of flowable product from the container.

The step of moving the actuator upwards may be accomplished by resilient action of the intermediate deformable portion of the resilient sleeve member.

The method may comprise the further steps of:

- removing the actuator from the resilient sleeve member, and
- cleaning the actuator to remove flowable product from the interior flow passage in the actuator.

Specific embodiments of the invention will now be described, by way of example only, with reference to the accompanying drawings in which.

Figure 1:
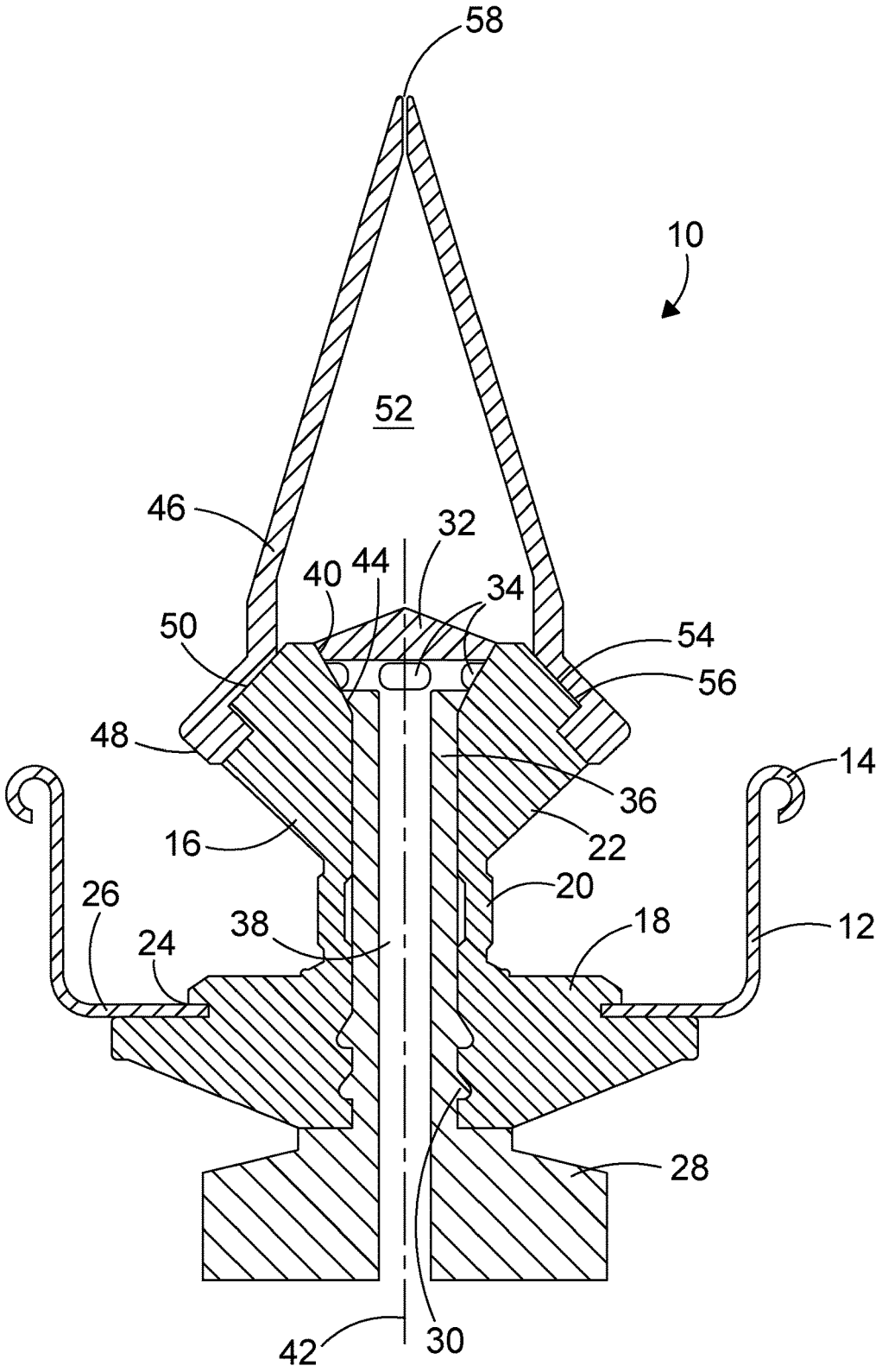
FIGS. 1 and 2 show a cross-sectional view of a valve assembly in accordance with a first embodiment of the present invention in closed and open positions respectively.
Figure 2:
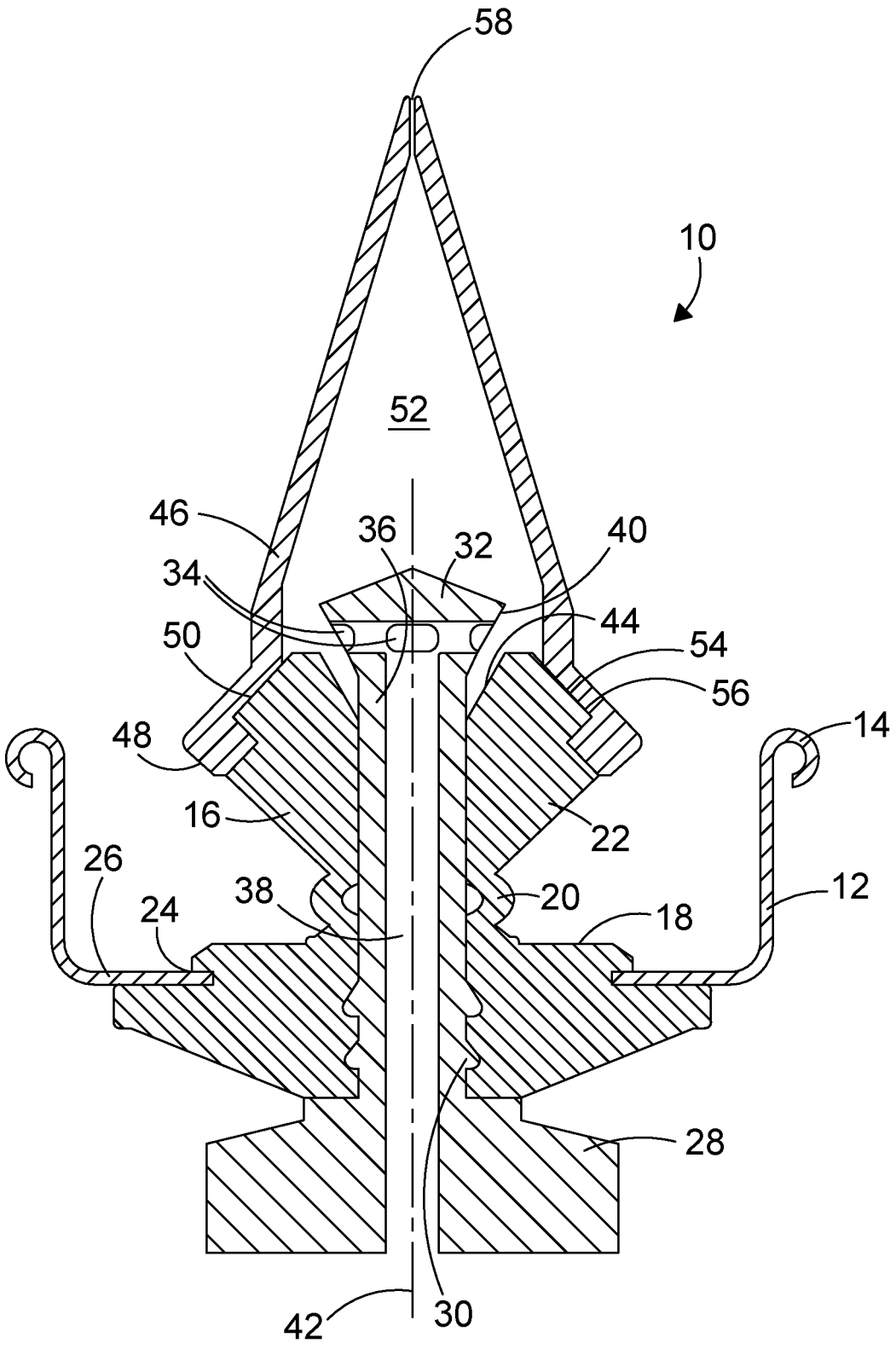

Referring firstly to FIGS. 1 and 2 of the accompanying drawings, a valve assembly 10 in accordance with an embodiment of the present invention will be described.

The valve assembly includes a mounting cup 12 with a rolled flange 14 of a standard 1 inch (25.4 mm) diameter adapted to fit onto standard apertures in pressurised containers. The rolled flange 14 is fitted in a known way to an upstand surrounding the aperture of the container.

A resilient sleeve member 16 comprises a lower fixing portion 18, an intermediate deformable portion 20 and an upper sealing portion 22. The sleeve member 16 may be of natural or synthetic rubber or other appropriate resilient material which can be moulded. In this example the sleeve member 16 is formed as a single homogenous moulding, but it can be formed of two, three or more separate components. The lower fixing portion 18 includes a retaining groove 24 which engages with a flange 26 of the mounting cup 12, so that the mounting cup 12 is fixed to the sleeve member 16, for example by moulding the sleeve member to the mounting cup.

The sleeve member 16 has an axial through passage in which is provided a valve stem 28. The valve stem includes retaining ribs 30 on its outer surface, which engage with corresponding recesses in the through passage of the lower fixing portion 18 of the sleeve member 16, so that the valve stem 28 is fixed and cannot move axially relative to the lower fixing portion 18 of the sleeve member 16.

The valve stem 28 extends upwards within the resilient sleeve member 16, passing through the intermediate deformable portion 20 and the upper sealing portion 22. It is free to slide axially with respect to the intermediate deformable portion 20 and the upper sealing portion 22.

At the upper end of the valve stem 28 is an end cap 32 and a plurality of radially extending apertures 34 arranged around the circumference of the tubular wall 36 of the hollow cylindrical body 38 of the valve stem 28 adjacent to the end cap 32. The end cap 32 closes the upper end of the hollow cylindrical body 38. The end cap 32 includes a sealing surface 40 which in this embodiment is a conical surface, angled at an acute angle to the vertical axis 42 of the valve stem 28. The sealing surface 40 engages in a sealing manner with a corresponding sealing surface 44 on the upper sealing portion 22 of the resilient sleeve member 16 in the closed position of the valve assembly 10 illustrated in FIG. 1. In this position the apertures 34 are covered by the upper sealing portion 22 of the resilient sleeve member 16.

An actuator 46 is mounted on the upper sealing portion 22 of the resilient sleeve member 16. In this embodiment the actuator 46 includes a flange 48 which push-fits over a projection 50 on the upper sealing portion 22. The actuator 46 has an interior flow passage 52 and a first actuator bearing surface 54 which engages with a corresponding bearing surface 56 on the upper sealing portion 22 of the resilient sleeve member 16. At the upper end of the interior flow passage 52 is a nozzle 58.

In this specification the term "downward" is used to refer to a direction parallel to the longitudinal axis of the valve stem 28 in a direction away from the nozzle 58, i.e. towards the bottom of the page as shown in the drawings. The term "upward" is used to refer to the opposite direction. The terms "lower" and "upper" are used to refer to locations further from and closer to the nozzle 58 respectively. The use of the terms is independent of the actual orientation of the valve assembly 10 in use. It is to be understood that in use the valve assembly 10 may be inverted in use, so that the an upper sealing portion 22 of the resilient sleeve member 16 may be temporarily below the lower fixing portion 18 of the resilient sleeve member 16.

If a downward force is applied to the actuator 46 when it is in the closed position of FIG. 1, the first actuator bearing surface 54 bears on the bearing surface 56 of the resilient sleeve member 16, causing the intermediate deformable portion 20 of the resilient sleeve member 16 to deform and adopt the position shown in FIG. 2, in which the valve assembly 10 is in an open position. In the open position the apertures 34 are not covered by the upper sealing portion 22 of the resilient sleeve member 16 so that there is an open passage through the valve assembly from the valve stem 28, through the apertures 34 and the interior flow passage 52 to the nozzle 58.

In the illustrated embodiment the intermediate deformable portion 20 comprises a thin tubular wall which readily deforms in a concertina fashion when subject to an axial compression force. Other shapes are possible.

The valve assembly 10 is sealed in the closed position of FIG. 1 by the upper sealing portion 22 of the resilient sleeve member 16, which seals against the valve stem 28 at its upper end. This means that after use any product remaining within the valve stem 28 is below the location of the seal at the seal surfaces 40, 44, and is not in communication with the atmosphere, so it will not deteriorate. The actuator 46 itself may be removed from the resilient sleeve member 16 in order to clean the actuator and/or to remove any product remaining within the actuator.

The actuator 46 may be urged downwards by any appropriate means. For example it may simply be pushed down manually. The actuator 46 may be urged downwards by operation of a lever (not shown), for example the lever assembly disclosed in WO 01/49585. The actuator 46 may be mounted for tilting movement, such that tilting the actuator from the closed position of the valve assembly to a tilted open position of the valve assembly causes the intermediate deformable portion 20 of the resilient sleeve member 16 to deform on one side, such only parts of the conical sealing surfaces 40, 44 are separated from each other, and one or more apertures 34 on one side of the valve stem 28 are uncovered by the upper sealing portion 22 of the resilient sleeve member 16.

As can be seen in FIG. 1, the end cap sealing surface 40 is inclined at an acute angle to the longitudinal axis 42 of the valve stem 28, and extends radially beyond the circular cylindrical wall 36 of the valve stem 28. This ensures a positive engagement of the sealing surfaces 40, 44 in the closed position of the valve assembly.

In the illustrated embodiment the actuator 46 is shown with an integrated nozzle 58 at its upper end. Alternatively the nozzle 58 may be provided as a separate component, for example a threaded component. The actuator 46 may include an engaging means, for example an external thread (not shown), on its external surface adapted to engage with a corresponding engagement means, for example an internal thread, on a separate nozzle member (not shown). The actuator 46 and nozzle member may have any appropriate shape, and are not limited to the shapes illustrated.

Figure 3:
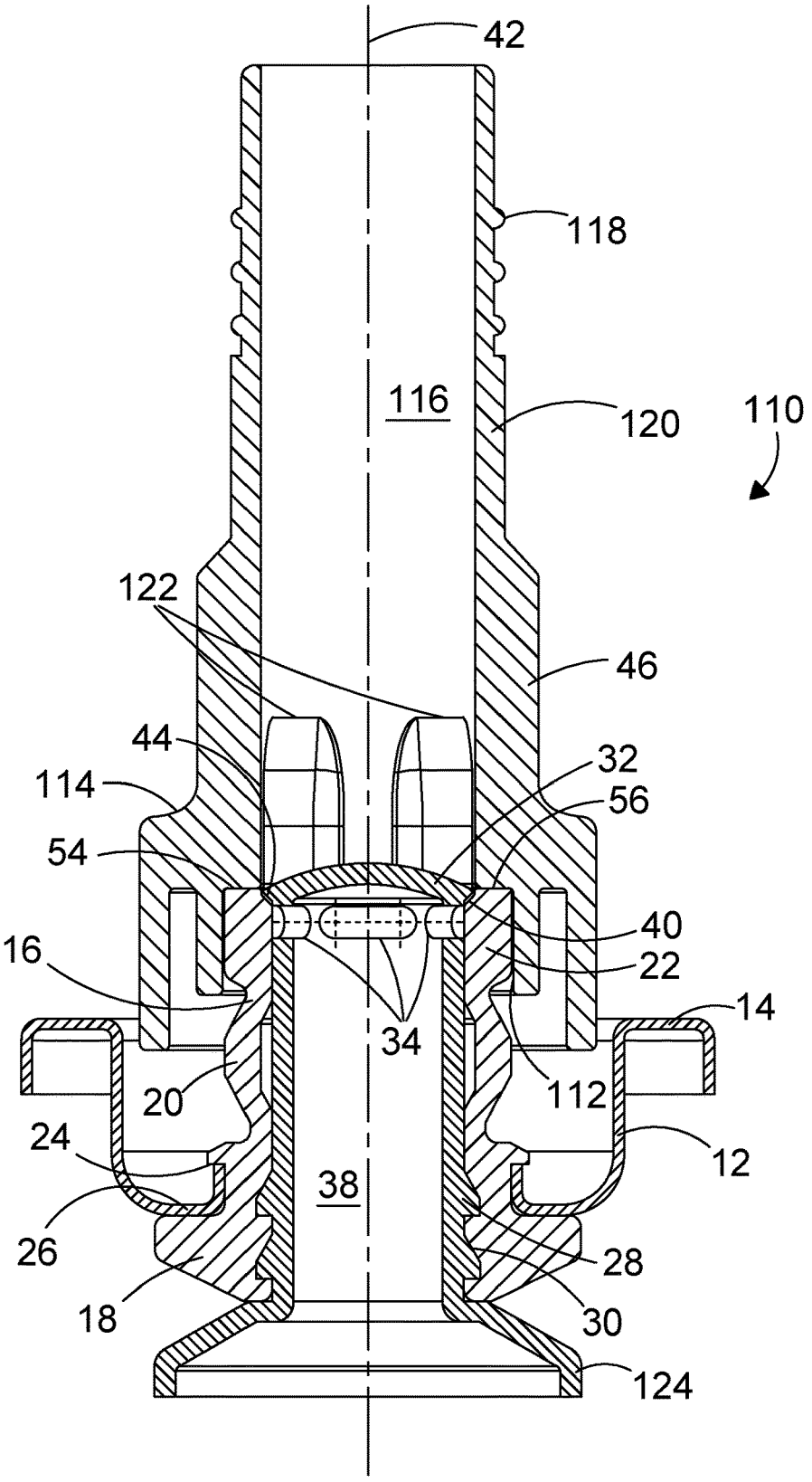
FIG. 3 shows a cross-sectional view of a valve assembly in accordance with a second embodiment of the present invention.
Figure 4:
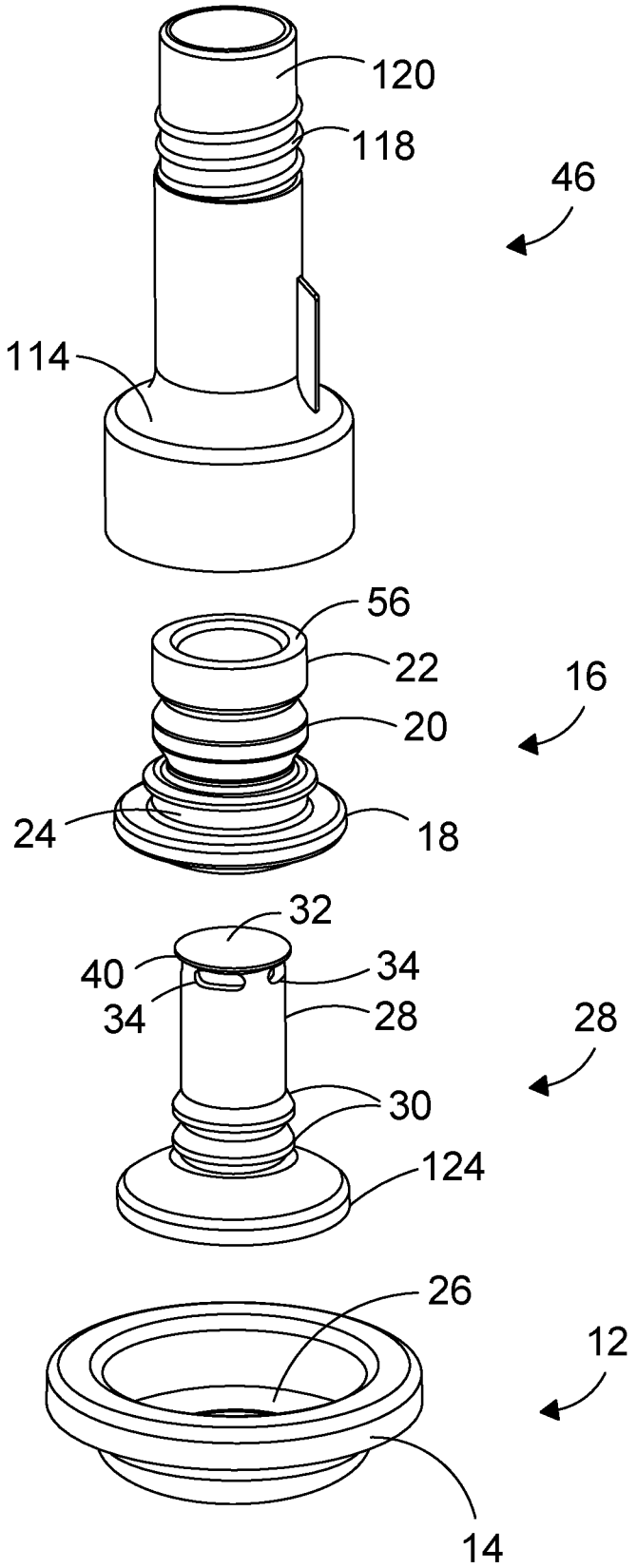
FIG. 4 is an exploded view of the components of the valve assembly of FIG. 3.

Referring to FIGS. 3 and 4, there is shown a valve assembly 110 in accordance with another embodiment of the present invention. Components of the valve assembly 110 of FIGS. 3 and 4 which serve the same purpose as the components of the valve assembly 10 of FIGS. 1 and 2 have the same reference number and are not further described.

In FIG. 3 the valve assembly 110 is shown in the closed position. In this embodiment the actuator 46 is removably mounted on the upper sealing portion 22 of the resilient sleeve member 16. The actuator 46 includes a recess 112 which slideably fits onto the upper sealing portion 22 of the resilient sleeve member 16, such that the actuator 46 may be removed from the resilient sleeve member 16 by simple pulling action for cleaning purposes. The actuator has an abutment surface 114 which is suitable for engagement by a corresponding abutment surface of a lever (not shown) for urging downward movement of the actuator 46, such as the lever illustrated in WO 01/49585.

The interior flow passage 116 of the actuator 46 is a generally cylindrical passage with no integral nozzle. Instead external threads 118 are provided at the exterior of the actuator wall 120. A nozzle assembly (not shown), for example a conical cap which can be cut in known manner by a user to provide a required nozzle diameter, may be secured to the external threads 118.

The interior flow passage 116 has an internal diameter greater than that of the valve stem 28, and greater than the external diameter of the end cap 32, so that there is at least a clearance fit between the end cap 32 and the interior flow passage 116 when the actuator is urged downwards relative to the end cap 32 from the closed position shown in FIG. 3. The interior flow passage 116 also includes a number of recesses 122 at its lower end adjacent to the first actuator bearing surface 54. These recesses 122 serve to provide a flow path for product exiting the apertures 34 under pressure into the interior flow passage 116 when the actuator 46 is urged downwards to the open position, so that dispensed product can flow around the end cap 32. Typically there are four recesses 122.

Figure 5:
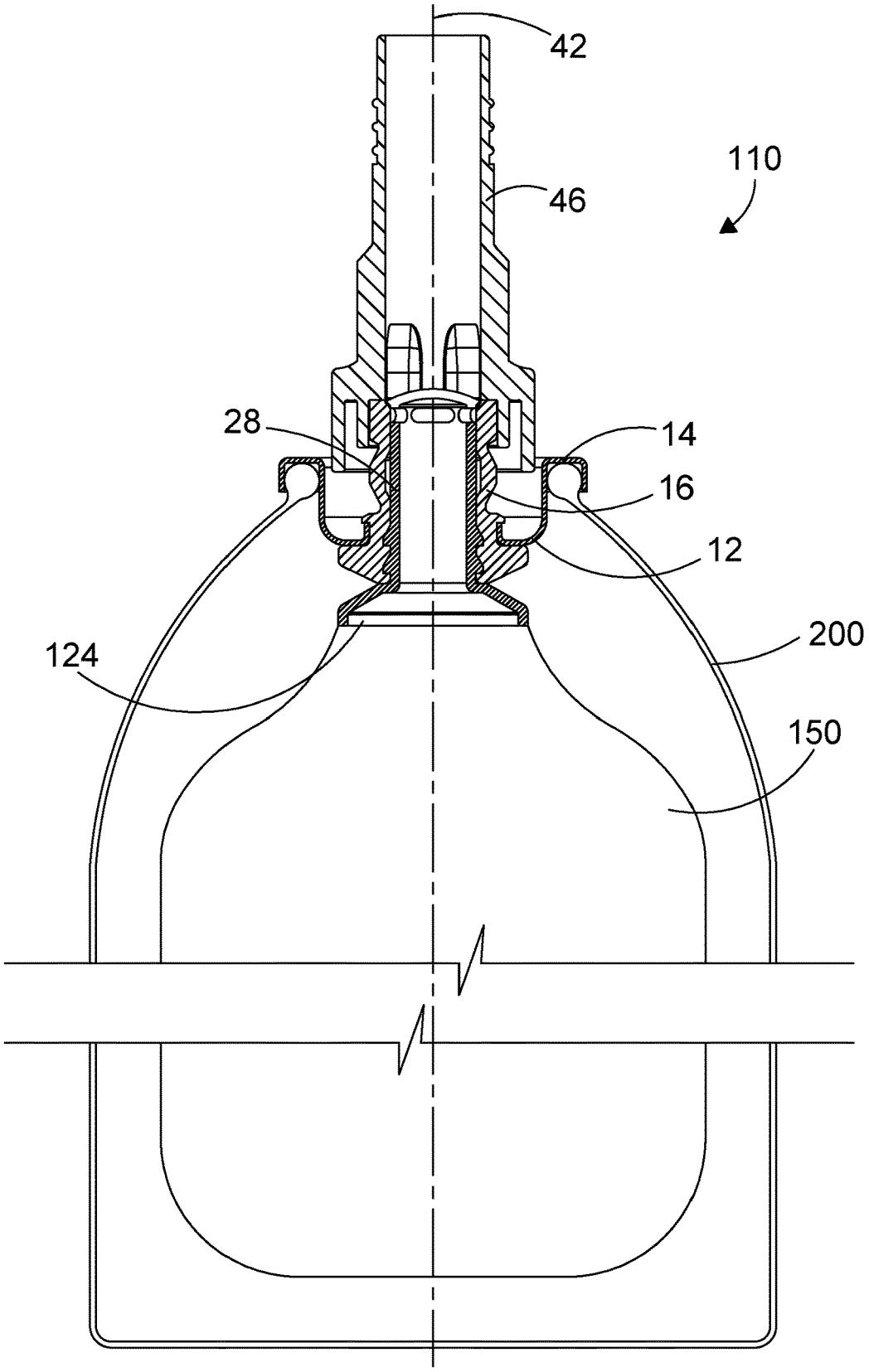
FIG. 5 shows a cross-sectional view of a dispensing apparatus including the valve assembly of FIG. 3.

At the lower end of the valve stem 28 there is a flange portion 124 to which in one embodiment can be attached a flexible membrane 150, for example a bag, containing the product to be dispensed, as shown in FIG. 5, which shows one embodiment of a container 200 to which the valve assembly 110 of FIGS. 3 and 4 is attached. The remaining volume 152 of the container 200 is occupied by propellant. The bag 150 is sealed to the flange portion 124 by any appropriate sealing means, for example a mechanical sealing means or an adhesive. Such a container containing pressurised propellant and a product to be dispensed may be referred to as a pressure pack.

The shape of the components of the valve assembly 10, 110 is not limited to the shape illustrated in the drawings. The valve assembly can be used with any suitable container, not only the container illustrated in FIG. 5. The actuator 46 may be made from several components, so that the portion which includes the first actuator bearing surface 54 may be separate from the portion which includes the interior flow passage 116.

The valve assembly 10, 110 of the present invention can be used to dispense any product which might deteriorate or solidify if left in a valve stem and exposed to the atmosphere. It has application in the fields of foodstuffs, sealants, adhesives, cosmetics, pharmaceuticals, and any other fields where a product should be protected from the atmosphere.

The invention is described using terms upper, lower, vertical, upwards and downwards. These terms refer to the orientation of the valve assembly as illustrated in the accompanying drawings. In this orientation the longitudinal axis of the valve assembly 10 and of the valve stem 28 is vertical. The end cap 32 is at the upper end of the valve stem 32, and movement of the actuator 42 towards the mounting cup 12 is referred to as a downwards movement. Of course in practice the valve assembly may be inverted during operation.

The valve assembly 10, 110 of the present invention has the advantage that after opening the valve assembly to dispense product and reclosing the valve assembly, any product in the valve stem 28 is sealed from the atmosphere, so will not deteriorate or harden. The only product open to the atmosphere is any product remaining in the interior flow passage 116 or the optional nozzle assembly (not shown) and both of these can be readily removed, cleaned and replaced without opening the valve, i.e. breaking the seal between the opposed seal surfaces 40, 44. Hence a dispensing apparatus fitted with the valve assembly 10, 110 of the present invention can be reused many times without risk of blocking of the valve stem or deterioration of product in the valve stem due to contact with the atmosphere.

Modifications and improvements may be made to the foregoing without departing from the scope of the invention as defined by the claims.

The invention claimed is:

1. A valve assembly for dispensing a flowable product from a pressurised container, the valve assembly comprising:

a resilient sleeve member comprising a lower fixing portion, an intermediate deformable portion and an upper sealing portion;

a valve stem extending within the resilient sleeve member and fixed to the lower fixing portion of the resilient sleeve member;

an actuator mounted on the upper sealing portion of the resilient sleeve member;

wherein the valve stem comprises a hollow cylindrical body, an end cap closing an upper end of the hollow cylindrical body, and one or more apertures arranged around a circumference of the hollow cylindrical body adjacent to the end cap, the apertures being covered and closed by the upper sealing portion of the resilient sleeve member in a closed position of the valve assembly; and wherein the actuator comprises an interior flow passage and a first actuator bearing surface adapted to engage with a corresponding bearing surface on the upper sealing portion of the resilient sleeve member, such that movement of the actuator downwards from the closed position of the valve assembly to an open position of the valve assembly causes the intermediate deformable portion of the resilient sleeve member to deform such that the apertures are open and not covered by the upper sealing portion of the resilient sleeve member.

2. The valve assembly according to claim 1, comprising a mounting cup, the resilient sleeve member being mounted within an aperture in the mounting cup.

3. The valve assembly according to claim 1, wherein the actuator comprises an interior flow passage.

4. The valve assembly according to claim 3, wherein in the open position of the valve assembly the hollow cylindrical body of the valve stem is in fluid communication through the one or more apertures with the interior flow passage of the actuator.

5. The valve assembly according to claim 1, wherein the actuator comprises a second actuator bearing surface.

6. The valve assembly according to claim 1, wherein the actuator is mounted on the upper sealing portion of the resilient sleeve member for tilting movement, such that tilting the actuator from the closed position of the valve assembly to a tilted open position of the valve assembly causes the intermediate deformable portion of the resilient sleeve member to deform such that at least one of the apertures is not covered by the upper sealing portion of the resilient sleeve member.

7. The valve assembly according to claim 1, wherein the end cap comprises an end cap sealing surface adapted to seal against a corresponding sealing surface of the upper sealing portion of the resilient sleeve member in the closed position of the valve assembly.

8. The valve assembly according to claim 1, wherein the hollow cylindrical body of the valve stem comprises an upper tubular portion having a uniform circular cylindrical wall, and wherein the end cap sealing surface is inclined at an acute angle to the longitudinal axis of the valve stem.

9. The valve assembly according to claim 1, comprising a nozzle at the upper end of the actuator.

10. A dispensing apparatus comprising a pressurised container, a flowable product in the container and a valve assembly according to claim 1 secured to an aperture in the container.

11. The dispensing apparatus according to claim 10, comprising a pressurised propellant in the container and a barrier means separating the pressurised propellant from the flowable product.

12. A method of dispensing a pressurised flowable product from a dispensing apparatus comprising a container and a valve assembly, the valve assembly comprising a resilient sleeve member comprising a lower fixing portion secured to an aperture in the container, an intermediate deformable portion and an upper sealing portion, a valve stem extending within the resilient sleeve member and fixed to the lower fixing portion of the resilient sleeve member, and an actuator provided on the upper sealing portion of the resilient sleeve member, the method comprising:

moving the actuator downwards from a closed position of the valve assembly, in which the upper sealing portion seals against a sealing surface at an upper end of the valve stem, to an open position of the valve assembly, in which at least part of the upper sealing portion is spaced from the sealing surface at the upper end of the valve stem;

propelling flowable product from the container though the valve stem, through at least one aperture in the valve stem adjacent to the sealing surface at the upper end of the valve stem, into an interior flow passage in the actuator, and through a nozzle in communication with the interior flow passage; and wherein the valve stem comprises a hollow cylindrical body, an end cap closing an upper end of the hollow cylindrical body, and one or more apertures arranged around the circumference of the hollow cylindrical body adjacent to the end cap, the apertures being covered and closed by the upper sealing portion of the resilient sleeve member in a closed position of the valve assembly.

13. The method according to claim 12, wherein the step of moving the actuator downwards comprises one of:

deforming the intermediate deformable portion of the resilient sleeve member against the resilience of the intermediate deformable portion;

applying a downwards force to the actuator so that the entire upper sealing portion is spaced from the sealing surface at the upper end of the valve stem; and tilting the actuator to one side such that part of the upper sealing portion is spaced from the sealing surface at the upper end of the valve stem.

14. The method according to claim 12, comprising moving the actuator upwards from the open position to the closed position to prevent the further propulsion of flowable product from the container.

* * * * *